US007513789B2

(12) United States Patent
Sasaki et al.

(10) Patent No.: US 7,513,789 B2
(45) Date of Patent: Apr. 7, 2009

(54) BASE CONNECTOR, SOCKET CONNECTOR AND COMPLEX TYPE CONNECTOR

(75) Inventors: Shoichi Sasaki, Osaka (JP); Mitsuhiro Matsumoto, Osaka (JP); Toshihiro Terashima, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/078,088

(22) Filed: Mar. 27, 2008

(65) Prior Publication Data

US 2008/0242153 A1 Oct. 2, 2008

(30) Foreign Application Priority Data

Mar. 29, 2007 (JP) ..... 2007-086862

(51) Int. Cl.
*H01R 13/627* (2006.01)

(52) U.S. Cl. ..... 439/352; 439/372

(58) Field of Classification Search ..... 439/352, 439/372, 595

See application file for complete search history.

(56) References Cited

FOREIGN PATENT DOCUMENTS

JP 2005-026156 A 1/2005

*Primary Examiner*—Briggitte R Hammond
(74) *Attorney, Agent, or Firm*—Rader, Fishman & Grauer, PLLC

(57) ABSTRACT

A base connector includes an insulating base housing and a plurality of base contacts retained by the base housing. An anterior wall of the base housing includes a central convex portion which is formed at the center portion in a left-and-right direction of the anterior face of the anterior wall and projects forward, and a pair of concave portions formed on both sides sandwiching the central convex portion therebetween. At least a part of the upper face on the anterior wall including the upper face of the central convex portion is formed as a flat face. The upper face of the anterior wall is provided with a wide portion including the upper face of the central convex portion and being relatively wide in the front-and-rear direction, and a pair of narrow portions relatively narrow in the front-and-rear direction corresponding in position to the pair of concave portions. The wide portion is provided with a flat adsorbed face, which can be adsorbed by an adsorption member.

15 Claims, 9 Drawing Sheets

71
41
2
6
71a
72
73
70
4
4a
23
7
17

BASE CONNECTOR, SOCKET CONNECTOR AND COMPLEX TYPE CONNECTOR

BACKGROUND OF THE INVENTION

1. Field of the Invention

The present invention relates to a base connector, a socket connector, and a complex type connector.

2. Description of Related Arts

An electric connector, which electrically connects a circuit board and electronic or electrical equipment, includes that having a first connector fixed to the surface of the circuit board and a second connector provided on a lead wire extending from electronic or electrical equipment and also inserted into the first connector (for example, refer to Document 1).

Document 1: Japanese Unexamined Patent Publication No. 2005-26156 (published on Jan. 27, 2005)

The first connector includes a so-called side-type connector in which, as described in the above Document 1, an outlet is opened in a direction parallel to the surface of the circuit board, and a so-called top-type connector in which the outlet is opened so as to face above the circuit board.

There is a case where an adsorption nozzle is used for mounting the first connector on the circuit board. Specifically, the adsorption nozzle first adsorbs the upper face of the first connector. Then, in this state, the first connector is pulled out of a package box. Further, the first connector thus pulled out is carried to a predetermined arrangement place on the circuit board, and the adsorption nozzle is separated from the first connector in a state that the first connector is disposed at the predetermined arrangement place.

However, where the first connector is a top-type connector, a outlet is opened on the upper face of the first connector. As a result, the upper face is smaller in area, thereby making it difficult to secure a sufficient area for adsorption.

Therefore, it is conceived that a tape is attached to the entire upper face of the first connector in advance to adsorb the first connector while a sufficient area is secured for adsorption. However, in this case, troublesome work is required to attach the tape to the first connector and to remove it after mounting of the first connector on the circuit board. Further, the tape becomes waste.

The present invention has been made taking the above-described circumstances into account. The object of the present invention is to provide a base connector, a socket connector and a complex type connector which are capable of reducing the time and effort for mounting them on a circuit board and also decreasing waste, while securing a sufficient adsorption power by use of adsorption members.

SUMMARY OF THE INVENTION

In order to achieve the above object, in a preferred aspect of the present invention, a base connector includes an insulating base housing and a plurality of base contacts retained by the base housing. The base housing includes a bottom wall for opposing a circuit board, an anterior wall, a posterior wall and a pair of side walls disposed in a left-and-right direction. The anterior wall is provided with an anterior face which faces forward and an upper face which faces upward. The anterior wall includes a central convex portion which is formed at the center portion in the left-and-right direction of the anterior face and projects forward, and a pair of concave portions formed on both sides sandwiching the central convex portion therebetween. At least a part of the upper face on the anterior wall including the upper face of the central convex portion is formed as a flat face. The upper face of the anterior wall is provided with a wide portion including the upper face of the central convex portion and being relatively wide in the front-and-rear direction, and a pair of narrow portions relatively narrow in the front-and-rear direction corresponding in position to the pair of concave portions. The wide portion is provided with a flat adsorbed face, which can be adsorbed by an adsorption member.

According to this aspect, the adsorbed face is formed at a wide portion. Thereby, the adsorbed face can be secured sufficiently in area. Further, since the adsorbed face is flat, it can be firmly attached to the adsorption member. As a result, it is possible to provide a sufficiently high adsorption power on adsorption of a base housing by the adsorption member. Further, there is eliminated a necessity for temporarily attaching an adsorbed member such as a tape to the upper face of the base housing to secure a face for adsorption for the purpose of increasing the adsorption power in adsorbing the base housing. Thus, there is no need for attaching and detaching the adsorbed member. Further, there is no need for using the adsorbed member itself. As a result, the time and effort necessary for mounting a base connector can be reduced to a great extent and waste can be reduced as well.

BRIEF DESCRIPTION OF THE DRAWINGS

FIG. 8 are sectional views for explaining a process for mounting a base connector on the surface of a circuit board.

DETAILED DESCRIPTION OF THE PREFERRED EMBODIMENTS

Preferred embodiments of the present invention are described with reference to the attached drawings.

Figure 1:
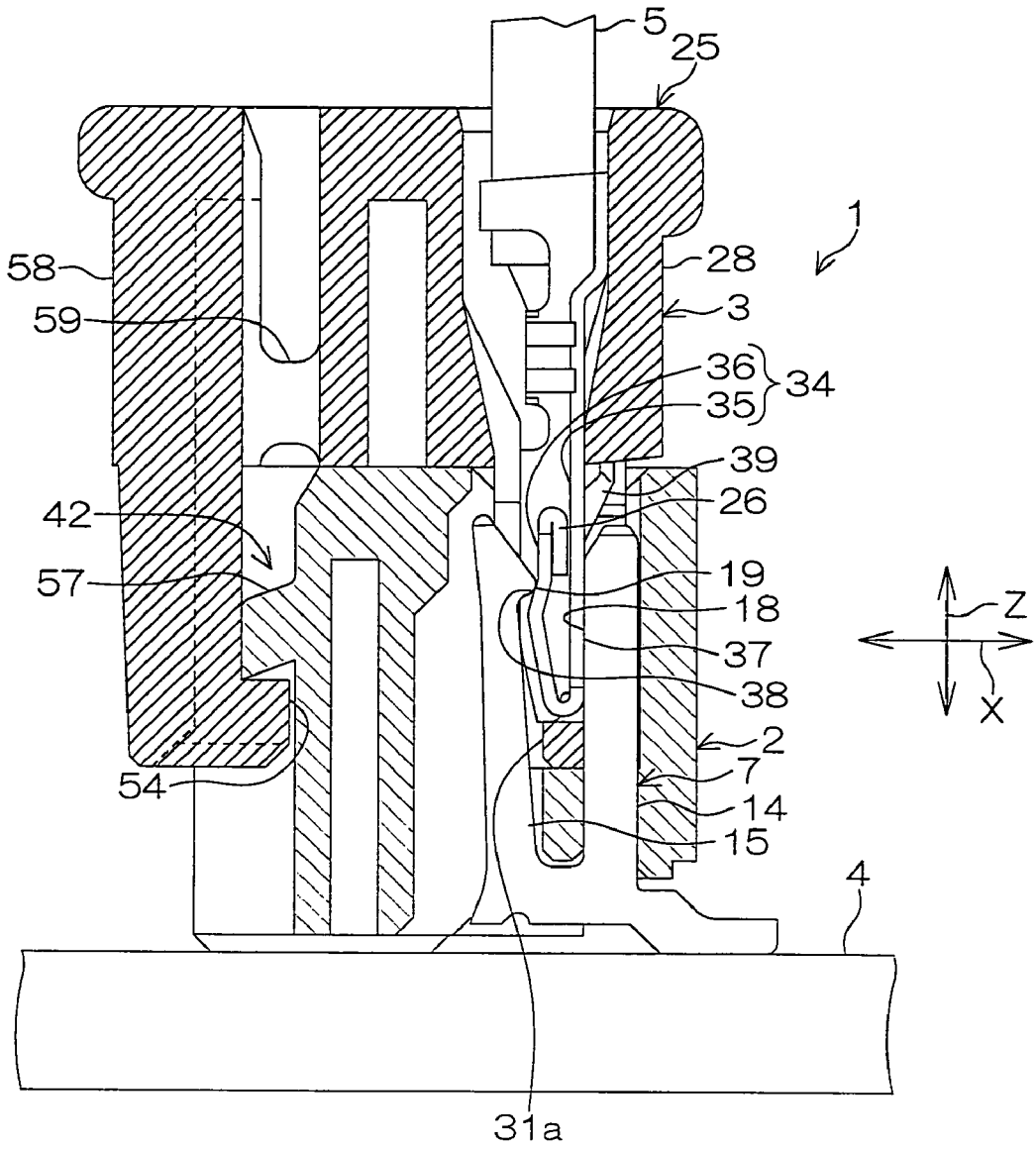
FIG. 1 is a sectional view of a complex type connector having a base connector and a socket connector according to one embodiment of the present invention, showing a state that the base connector and the socket connector are coupled to each other.
Figure 2:
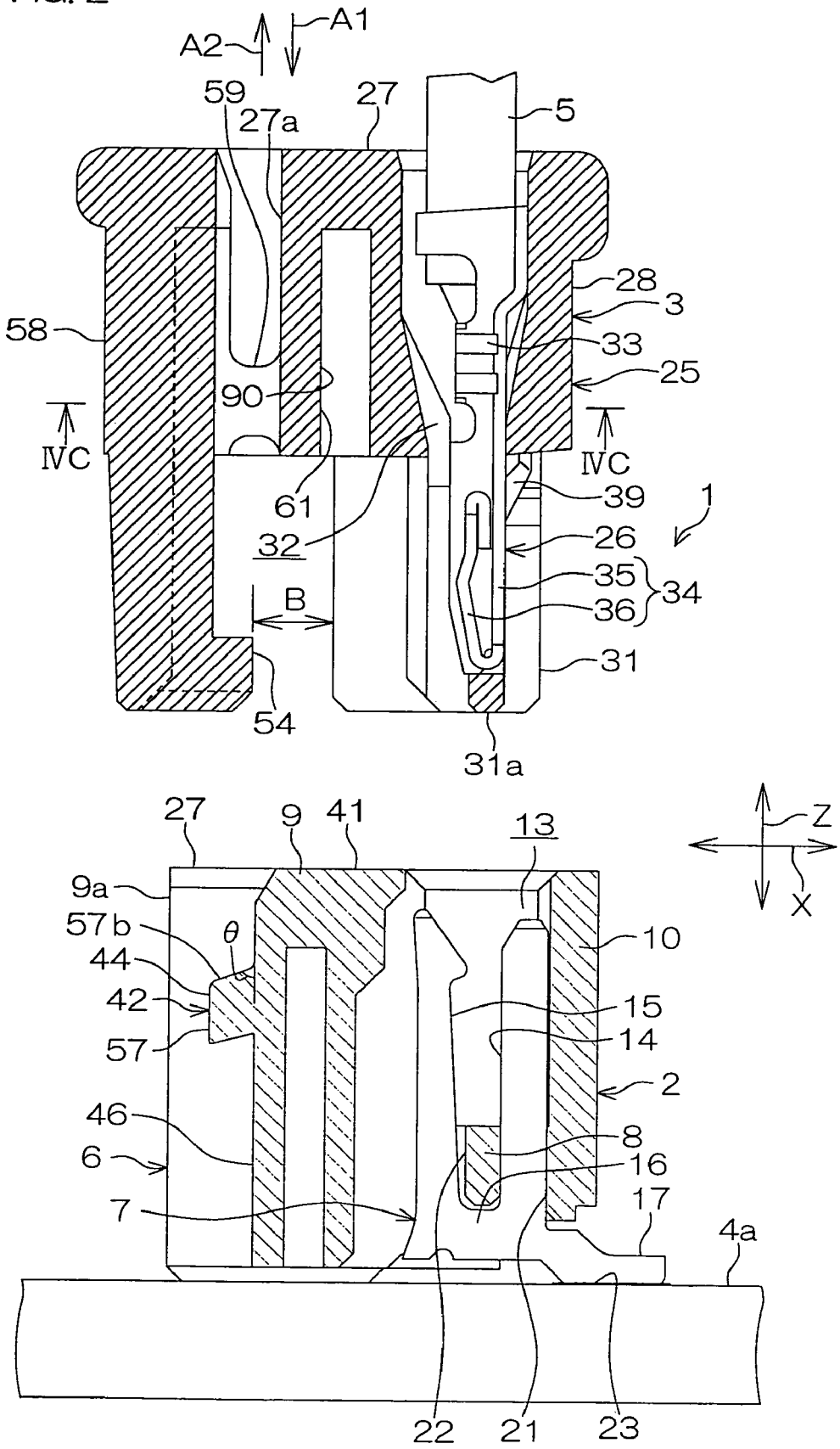
FIG. 2 is a sectional view of the complex type connector, showing a state that the base connector and the socket connector are decoupled.

FIG. 1 is a sectional view of a complex type connector 1 provided with a base connector 2 and a socket connector 3 according to one embodiment of the present invention, showing a state that the base connector 2 and the socket connector 3 are coupled to each other. FIG. 2 is a sectional view of the complex type connector 1, showing a state that the base connector 2 and the socket connector 3 are decoupled.

With reference to FIG. 1, the complex type connector 1 connects electrically a circuit board 4 with electronic equipment or electrical equipment (not illustrated) to which a lead wire 5 is connected. The complex type connector 1 is provided with the base connector 2 and the socket connector 3 as a counterpart connector which pairs with the base connector 2.

Figure 3A:
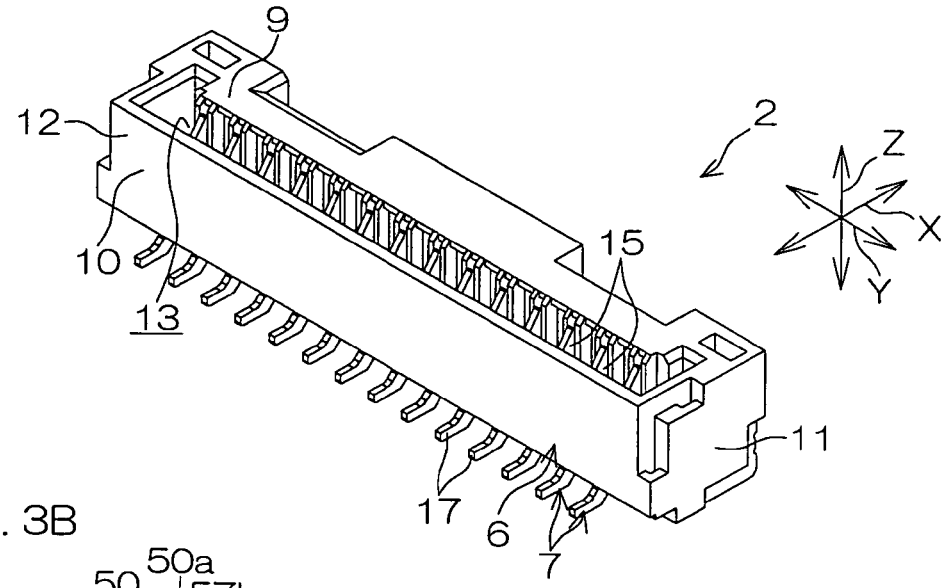
FIG. 3A is a perspective view of the base connector.

With reference to FIG. 2 and FIG. 3A, the base connector 2 is mounted on a surface 4*a* of the circuit board 4, including a base housing 6 and a plurality of base contacts 7 retained by the base housing 6.

The base housing 6 is an insulating member formed by a synthetic resin and integrally formed by a single member. The base housing 6 is provided with a bottom wall 8, an anterior wall 9, a posterior wall 10 and a pair of side walls 11, 12.

Hereinafter, any direction is given on the basis of a posture of the base connector 2 mounted on the circuit board 4 (posture in a mounted state).

Specifically, a direction parallel to a direction at which the anterior wall 9 and the posterior wall 10 oppose each other is referred to as a front-and-rear direction X, a direction parallel to a direction at which the pair of side walls 11, 12 oppose each other is referred to as a left-and-right direction Y, and a direction orthogonal to both the front-and-rear direction X and the left-and-right direction Y is referred to as a vertical direction Z.

The front-and-rear direction X is a direction parallel to a principal face of the circuit board 4 in a state that the base connector 2 is mounted. Further, the left-and-right direction Y is a direction parallel to the principal face of the circuit board 4 in a state that the base connector 2 is mounted. The vertical direction Z is a direction perpendicular to both the left-and-right direction Y and the front-and-rear direction X, and coincides with a normal line direction on the principal face of the circuit board 4 in a state that the base connector 2 is mounted.

The base connector 2 is symmetrical in the left-and-right direction Y. The base housing 6 is formed, for example, relatively long in the left-and-right direction Y and relatively short in the front-and-rear direction X. The bottom wall 8 is opposed to the surface 4*a* of the circuit board 4.

The anterior wall 9 is provided with an anterior face 9*a* facing forward and an upper face 9*b* facing upward.

The anterior wall 9 and the posterior wall 10 are each formed in a rectangular shape and are disposed parallel to each other. The anterior wall 9 is relatively thick and the posterior wall 10 is relatively thin. The pair of side walls 11, 12 are disposed along the left-and-right direction Y and parallel to each other.

An insertion concave portion 13 opened upward is defined by the bottom wall 8, the anterior wall 9, the posterior wall 10 and the pair of side walls 11, 12. An insertion convex portion 31 of the socket connector 3 to be described later can be inserted into the insertion concave portion 13. The plurality of base contacts 7 are each accommodated in the insertion concave portion 13. These base contacts 7 are arrayed side by side along the left-and-right direction Y.

The base contact 7 is a plate member made by pressing a conductive metal member and the entire body thereof is integrally formed by a single member. The base contact 7 is formed in a generally U shape. The base contact 7 is provided with a pair of tabs 14, 15 extending in the vertical direction Z, a connecting portion 16 connecting the base ends of the pair of tabs 14, 15, and a tongue 17 extended from the connecting portion 16.

A distance between the leading ends of the pair of tabs 14, 15 is made shorter than that between the base ends. As shown in FIG. 1, contact portions 18, 19 are formed when the respective leading ends of the pair of tabs 14, 15 are made to contact with a socket contact 26 of the socket connector 3 to be described later.

Figure 3B:
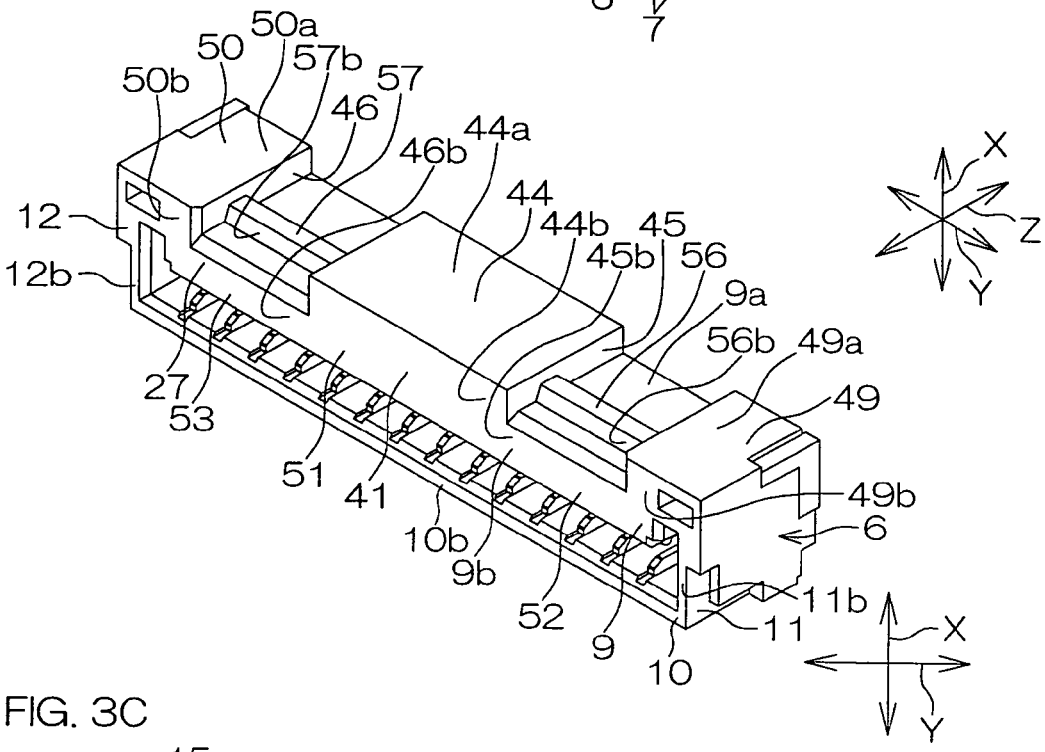
FIG. 3B is a perspective view of the base connector.
Figure 3C:
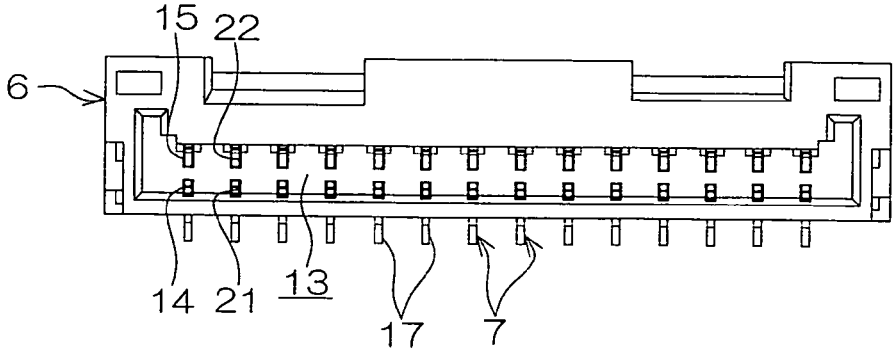
FIG. 3C is a plan view of the base connector.

With reference to FIG. 2 and FIG. 3C, the pair of tabs 14, 15 of the base contact 7 are accommodated inside the insertion concave portion 13 in a state that they are respectively inserted through corresponding insertion holes 21, 22 on the bottom wall 8. The base end of the one tab 14 is press-fitted and fixed into the insertion hole 21.

The tongue 17 of the base contact 7 projects from the posterior wall 10 of the base housing 6 and is made to contact with a conductor pattern 23 on the surface 4*a* of the circuit board 4. The tongue 17 and the conductor pattern 23 are soldered by using cream solder or the like. They are electrically connected to each other. In this manner, the base contact 7 is mounted on the surface 4*a* of the circuit board 4.

Figure 4A:
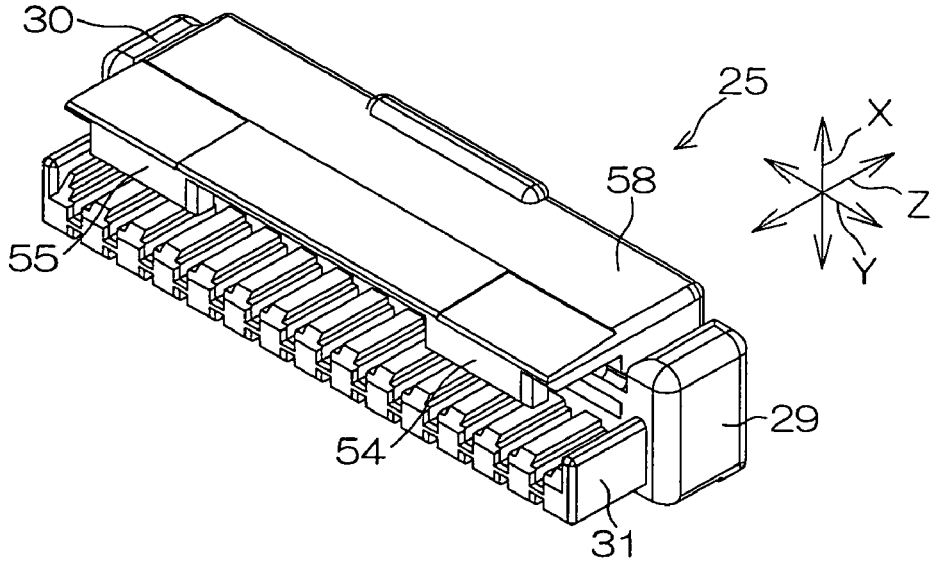
FIG. 4A is a perspective view of a socket housing.
Figure 4B:
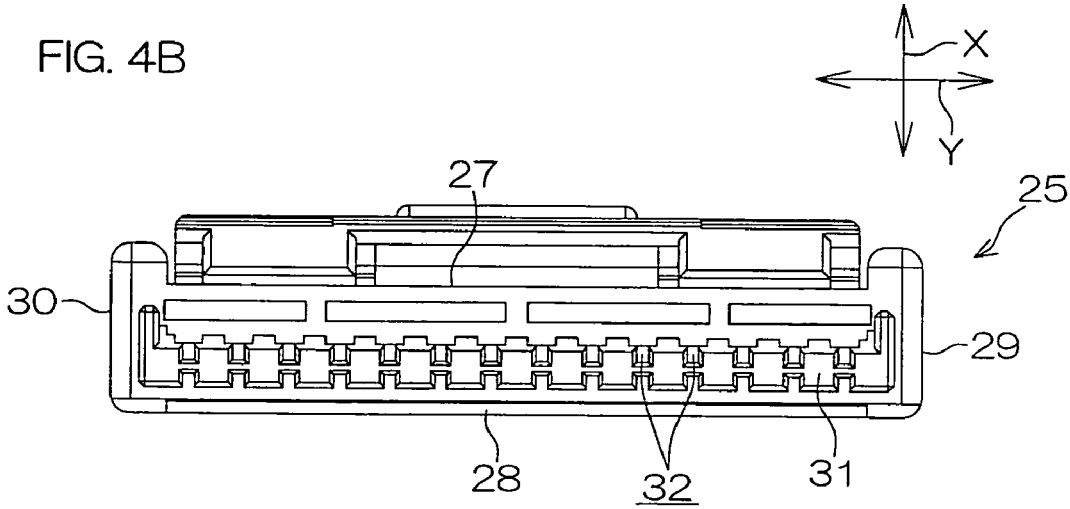
FIG. 4B is a side view of the socket housing.

With reference to FIG. 2, FIG. 4A and FIG. 4B, the socket connector 3 is symmetrical in the left-and-right direction Y, including a socket housing 25 and a plurality of socket contacts 26 retained by the socket housing 25.

The socket housing 25 is an insulating member formed by a synthetic resin and the entire body thereof is integrally formed by a single member. The socket housing 25 and the base housing 6 are coupled and locked in a releasable manner.

The socket housing 25 is provided with an anterior wall 27, a posterior wall 28, a pair of side walls 29, 30 and an insertion convex portion 31. The anterior wall 27 and the posterior wall 28 are each formed generally in a rectangular shape and are disposed parallel to each other. The anterior wall 27 and the posterior wall 28 oppose each other in the front-and-rear direction X. The pair of sidewalls 29, 30 oppose each other in the left-and-right direction Y.

The insertion convex portion 31 extends downward with respect to the anterior wall 27, the posterior wall 28 and the pair of side walls 29, 30 and is the inserted into the insertion concave portion 13 of the base housing 6.

A plurality of accommodating spaces 32 for accommodating the socket contacts 26 are defined along the left-and-right direction Y in the socket housing 25. Each of the accommodating spaces 32 is defined between the anterior wall 27 and the posterior wall 28 of the socket housing 25 and also extends to the insertion convex portion 31 side. A corresponding socket contact 26 is inserted into each of the accommodating spaces 32.

With reference to FIG. 2, the socket contact 26 is a plate member made by pressing a conductive metal member and the entire body thereof is integrally formed by a single member. The socket contact 26 is formed in a thin and long shape in the vertical direction Z. A cramping portion 33 provided on the intermediate portion of the socket contact 26 is pressed against the one end of the lead wire 5, whereby it is electrically connected to the lead wire 5.

The socket contact 26 includes an elastic piece portion 34 for coming into contact with the base contact 7. The elastic piece portion 34 includes a first portion 35 extended from the cramping portion 33 and a second portion 36 folded back from the first portion 35.

As shown in FIG. 1, the first and second portions 35, 36 form respective contact portions 37, 38 which are in contact with the corresponding contact portions 18, 19 of the pair of tabs 14, 15 of the base contact 7. The socket contact 26 is made to contact with the base contact 7, whereby the socket contact 26 is electrically connected with the base contact 7.

With reference to FIG. 2, a retaining pin 39 projecting from the elastic piece portion 34 is received at the lower end of the posterior wall 28. Further, a leading end 31*a* of the insertion convex portion 31 is disposed in proximity to the one end of the socket contact 26. Thereby, the socket contact 26 is prevented from slipping off from the accommodating space 32 of the socket housing 25.

With reference to FIG. 2 and FIG. 3B, when the base housing 6 is mounted on the circuit board 4, the base housing 6 is carried above the circuit board 4 in association with movement of an adsorption member to be described later in a state of being adsorbed by the adsorption member, and then placed on the circuit board 4.

Features of the present embodiment include (1) the point that the base housing 6 is provided with a flat adsorbed face 41 which can be adsorbed by the adsorption member, and that the area of the adsorbed face 41 is made as large as possible, and (2) the point that a lock mechanism 42 for locking the base housing 6 and the socket housing 25 in a releasable manner from each other is provided in a compact construction.

More specifically, the base housing 6 includes a central convex portion 44 formed on the anterior wall 9 and projecting forward, and a pair of concave portions 45, 46 formed on the anterior wall 9 on both the sides sandwiching the central convex portion 44 therebetween in the left-and-right direction Y.

The central convex portion 44 is disposed at the center portion of the anterior face 9*a* of the anterior wall 9 with regard to the left-and-right direction Y, extending long in the left-and-right direction Y.

The pair of concave portions 45, 46 are respectively adjacent to the central convex portion 44. Each of the concave portions 45, 46 is set in depth, for example, at generally half of the thickness of the anterior wall 9. The central convex portion 44 is longer than each of the concave portions 45, 46 with respect to the left-and-right direction Y.

With respect to the left-and-right direction Y, a pair of ribs 49, 50 extending in the vertical direction Z and also projecting forward are respectively formed at a pair of ends of the anterior wall 9. Anterior faces 49*a*, 50*a* of the pair of ribs 49, 50 are formed as flat faces and are flush with the anterior face 44*a* of the central convex portion 44.

The upper face 9*b* of the anterior wall 9 is formed as a flat face disposed as a whole on the flush plane to face upward and is orthogonal to the vertical direction Z. Thereby, an upper face 44*b* of the central convex portion 44, upper faces 45*b*, 46*b* at portions corresponding in position to the pair of concave portions 45, 46 and upper faces 49*b*, 50*b* of a pair of ribs 49, 50 are flush with one another. Further, the respective upper faces 9*b*, 10*b*, 11*b* and 12*b* of the anterior wall 9, the posterior wall 10 and the pair of side walls 11, 12 are formed as flat faces and are flush with one another.

According to the above constitution, the upper face 9*b* of the anterior wall 9 is provided with a rectangular wide portion 51 including the upper face 44*b* of the central convex portion 44 and relatively wide in the front-and-rear direction X, and a pair of rectangular narrow portions 52, 53 relatively narrow in the front-and-rear direction X and respectively corresponding in position to the pair of concave portions 45, 46. The adsorbed face 41 is formed at the wide portion 51.

With reference to FIG. 2, FIG. 3B and FIG. 4A, the lock mechanism 42 includes a pair of locking pawls 54, 55 provided in the socket housing 25 and a pair of ridges 56, 57 provided in the base housing 6 and serving as engagement portions to engage with the corresponding locking pawls 55, 54.

The pair of ridges 56, 57 are respectively disposed inside the corresponding concave portions 45, 46 on the base housing 6 and thus accommodated inside the concave portions 45, 46, and serve as reinforcing portions for respectively connecting the ribs 49, 50 to the corresponding central convex portion 44. The ridges 56, 57 are each formed in a similar shape. With reference to FIG. 2, upper faces 56*b*, 57*b* of the ridges 56, 57 (only the upper face 57*b* is shown in FIG. 2) are each set, for example, in a range of more than 0° and not more than 90° in an inclination angle θ with respect to the corresponding bottom of the concave portion 45 or 46. In addition, the bottoms of the concave portions 45, 46 are rear ends of the concave portions 45, 46.

The inclination angle θ is made larger than 0°, whereby each of the ridges 56, 57 can be formed. Further, the inclination angle θ is set to be 90° or lower, whereby the locking pawls 55, 54 can slide smoothly on the corresponding upper faces 56*b*, 57*b* respectively.

The inclination angle θ is preferably set in a range of 20° to 90°. The inclination angle θ is set to be 20° or greater, thus making it possible to secure the sufficient height of each of the ridges 56, 57. As a result, the locking pawls 55, 54 can respectively be engaged securely with the corresponding ridges 56, 57, whereby a sufficient engagement force is provided between the locking pawls 55, 54 and the corresponding ridges 56, 57, thus securely locking them.

The inclination angle θ is more preferably set in a range of 30° to 70°. The inclination angle θ is set in this range, whereby a resistance generated on engagement of the corresponding locking pawls 55, 54 with the upper faces 56*b*, 57*b* can be set to a value which is not excessively small but not excessively large. As a result, an appropriate response can be given to an operator on engagement of the locking pawls 55, 54 with the corresponding ridges 56, 57.

As described above, the lower limit of the inclination angle θ is set to be a value exceeding 0°, preferably 20°, and more preferably 30°. Further, the upper limit of the inclination angle θ is set to be 90°, preferably at 70°.

With reference to FIG. 2 and FIG. 4A, the pair of locking pawls 54, 55 are provided on a rocking plate 58. The rocking plate 58 is supported by a supporting portion 59 formed projectedly on the anterior face 27*a* of the anterior wall 27 of the socket housing 25.

Figure 4C:
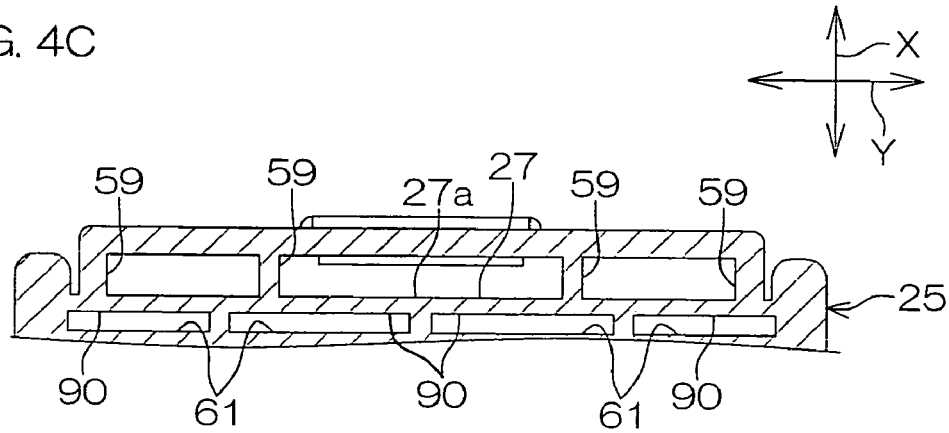
FIG. 4C is a sectional view showing a major part taken along the IVC to IVC line in FIG. 2.

With reference to FIG. 2 and FIG. 4C, a plurality of the supporting portions 59 are provided at predetermined intervals in the left-and-right direction Y. In the present embodiment, the supporting portions 59 are provided, for example, at four positions. With respect to the vertical direction Z, each of the supporting portions 59 is formed shorter than the anterior face 27*a* of the anterior wall 27.

The rocking plate 58 is formed in a rectangular plate shape by using a single member and can be rockingly operated with the leading end of the supporting portion 59 as a fulcrum.

With respect to the vertical direction Z, the leading end of the supporting portion 59 is connected to an intermediate portion of the rocking plate 58, and the pair of the locking pawls 54, 55 are connected to the lower end of the rocking plate 58.

Each of the locking pawls 54, 55 projects toward the insertion convex portion 31 with respect to the rocking plate 58. Thereby, a distance B is made short between each of the locking pawls 54, 55 and the insertion convex portion 31 with respect to the front-and-rear direction X.

A hollow portion 61 opposing the base end of the supporting portion 59 in the front-and-rear direction X is formed on the anterior wall 27 of the socket housing 25. The hollow portions 61 prevent the support rigidity of the supporting portion 59 by the anterior wall 27 from being excessively great, and are provided, for example, at four positions corresponding to the supporting portions 59.

In the present embodiment, with respect to the left-and-right direction Y, each of the supporting portions 59 is disposed closely to one end of the corresponding hollow portion 61. In addition, with respect to the left-and-right direction Y, each of the supporting portions 59 may be disposed at the center portion of the corresponding hollow portion 61.

Each of the hollow portions 61 is constituted by forming an insertion hole 90 in the anterior wall 27 of the socket housing 25. The insertion hole 90 is opened at least in one direction, that is, either in a connector connecting direction A1 or a reverse direction A2 thereof. The connector connection direction A1 is a direction parallel to the vertical direction Z, running from above to below. The reverse direction A2 is a direction parallel to the vertical direction Z, running from below to above.

In the present embodiment, each of the hollow portions 61 is constituted by forming the insertion hole 90 opened in the connector connecting direction A1 in the anterior wall 27 of the socket housing 25.

Figure 5A:
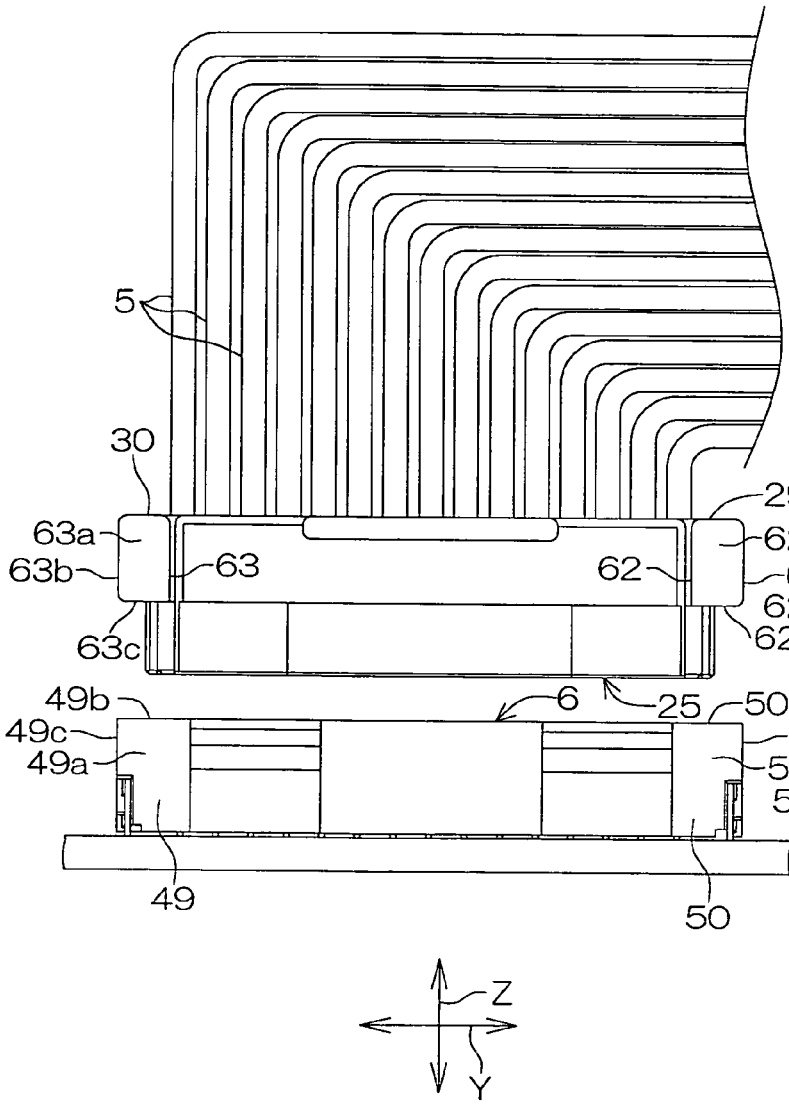
FIG. 5A is a side view when the complex type connector is viewed from the front, showing a state that the base connector and the socket connector are decoupled.
Figure 5B:
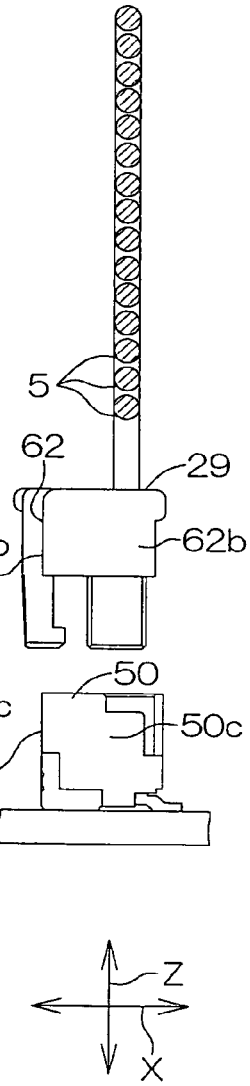
FIG. 5B is a side view of the complex type connector when viewed from the right, showing a state that the base connector and the socket connector are decoupled.

With reference to FIG. 5A and FIG. 5B, forward projecting projections 62, 63 are formed respectively on the pair of lateral side walls 29, 30 on the socket housing 25. Each of the projections 62, 63 is for confirming that the socket housing 25 is completely fitted in the base housing 6, including anterior faces 62*a*, 63*a*, one-side faces 62*b*, 63*b* facing outside in the left-and-right direction Y and lower faces 62*c*, 63*c*.

When the socket housing 25 is completely fitted in the base housing 6, the lower faces 62*c*, 63*d* of the respective projections 62, 63 are made to contact with the upper faces 50*b*, 49*b* of the corresponding ribs 50, 49 on the base housing 6. At this time, the anterior faces 62*a*, 63*a* of the respective projections 62, 63 are flush with the anterior faces 50*a*, 49*a* of the corresponding ribs 50, 49 on the base housing 6.

Further, the one-side faces 62*b*, 63*b* facing outside in the left-and-right direction Y of the projections 62, 63 are flush with one-side faces 50*c*, 49*c* facing outside in the left-and-right direction Y of the corresponding ribs 50, 49 of the base housing 6. A part of each lead wire 5 is connected to electronic equipment or electrical equipment, for example, in a state of being bent toward one side of the left-and-right direction Y.

Figure 6:
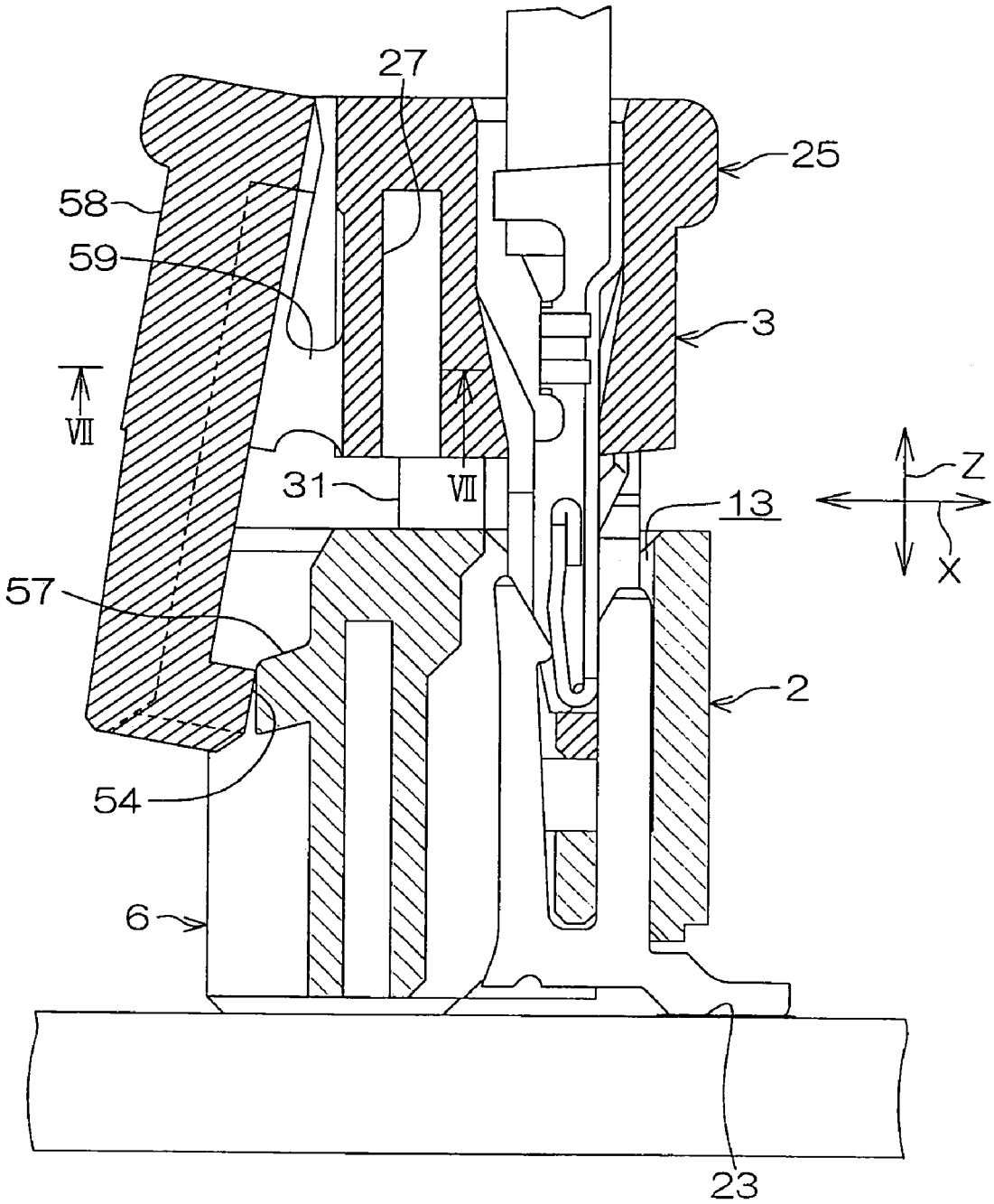
FIG. 6 is a sectional view for explaining work for coupling the socket connector with the base connector, showing a state that a rocking plate is rocked.

In the complex type connector 1 which is generally constituted as described above, the base connector 2 is connected to the socket connector 3 in the following manner. First, as shown in FIG. 2, in a state that the circuit board 4 is disposed horizontally, the socket connector 3 is opposed to the base connector 2. In this state, as shown in FIG. 6, the insertion convex portion 31 of the socket connector 3 is inserted into the insertion concave portion 13 of the base connector 2. At this time, the locking pawls 54, 55 of the socket connector 3 are respectively engaged with the corresponding ridges 57, 56, whereby the rocking plate 58 is rocked with the leading end of the supporting portion 59 as a fulcrum, and each of the locking pawls 54, 55 moves so as to be spaced away from the insertion convex portion 31. Each of the locking pawls 54, 55 of the socket connector 3 rides over the corresponding ridges 57, 56, thereby moving downward.

Figure 7:
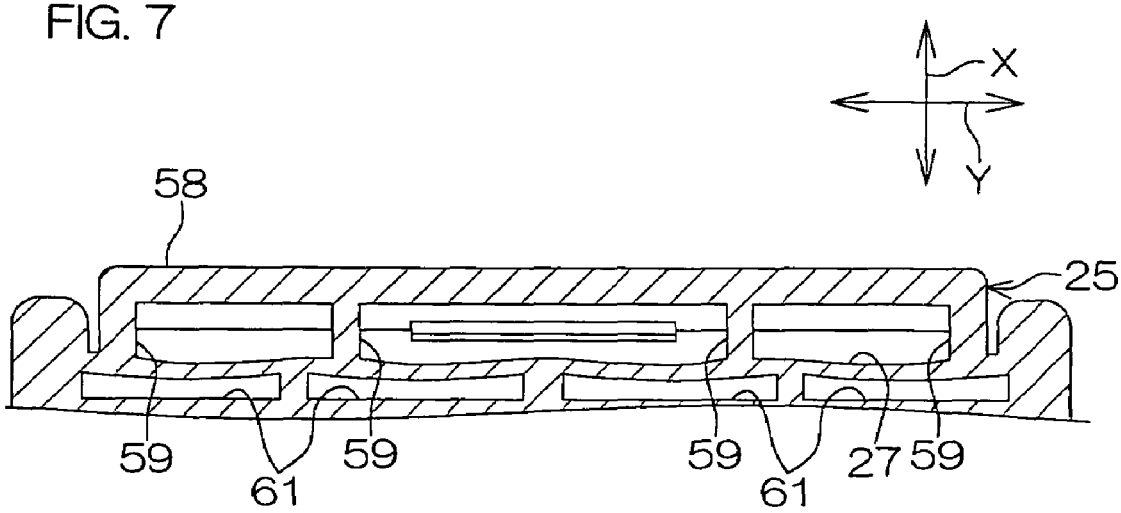
FIG. 7 is a sectional view showing a major part taken along the line VII to VII line in FIG. 6.

At this time, a force transmitted from the ridges 57, 56 to the corresponding locking pawls 54, 55 is transmitted via the rocking plate 58 and the supporting portions 59 to the anterior wall 27 of the socket housing 25. Thereby, as shown in FIG. 7, portions of the anterior wall 27 are flexibly bent toward the hollow portions 61. As a result, the anterior wall 27 elastically deforms in a waveform, and the supporting portions 59 are entirely displaced backward.

Then, when the socket connector 3 is further pressed downward, as shown in FIG. 1, the locking pawls 54, 55 are respectively engaged with the ridges 57, 56. Thereby, the lock mechanism 42 is in a state of being completely locked. In other words, a mutually connected state of the base connector 2 with the socket connector 3 is locked.

At this time, the contact portions 37, 38 of the elastic piece 34 of the socket contact 26 are respectively made to contact with the corresponding contact portions 18, 19 of the pair of tabs 14, 15 of the base contact 7.

In addition, when the socket connector 3 is removed from the base connector 2, an operator will pick up a socket housing 25 by fingers to press the rear end in the vertical direction Z of the rocking plate 58. Thereby, the rocking plate 58 is rocked around the supporting portions 59. Thereby, the engagement of the locking pawls 54, 55 with the corresponding ridges 57, 56 is released, and, in this state, the socket connector 3 is pulled up from the base connector 2.

Further, the base connector 2 is mounted on the surface 4*a* of the circuit board 4 in the following manner. First, with reference to FIG. 8A, the base connector 2 accommodated in an embossed tape formed in a band shape is taken out by using an adsorption member 71. Specifically, the embossed tape 70 is provided with a plurality of accommodating chambers 72, and the base connector 2 is accommodated in each of the accommodating chambers 72. The accommodating chamber 72 is formed in a box shape opened upward.

In a state that a cover tape (not illustrated) for covering the upper face of the embossed tape 70 is peeled off, at least a part of the leading end of an adsorption nozzle 71*a* on the adsorption member 71 is made to contact with the adsorbed face 41 of the base housing 6. The adsorption nozzle 71*a* is formed in a cylindrical shape, and the leading end face opposing the adsorbed face 41 is formed as a flat face. The accommodating chamber 72 of the embossed tape 70 is provided with a release portion 73 for introducing therein the adsorption nozzle 71*a*.

Figures 8A, 8B, 8C, 8D, 8E:
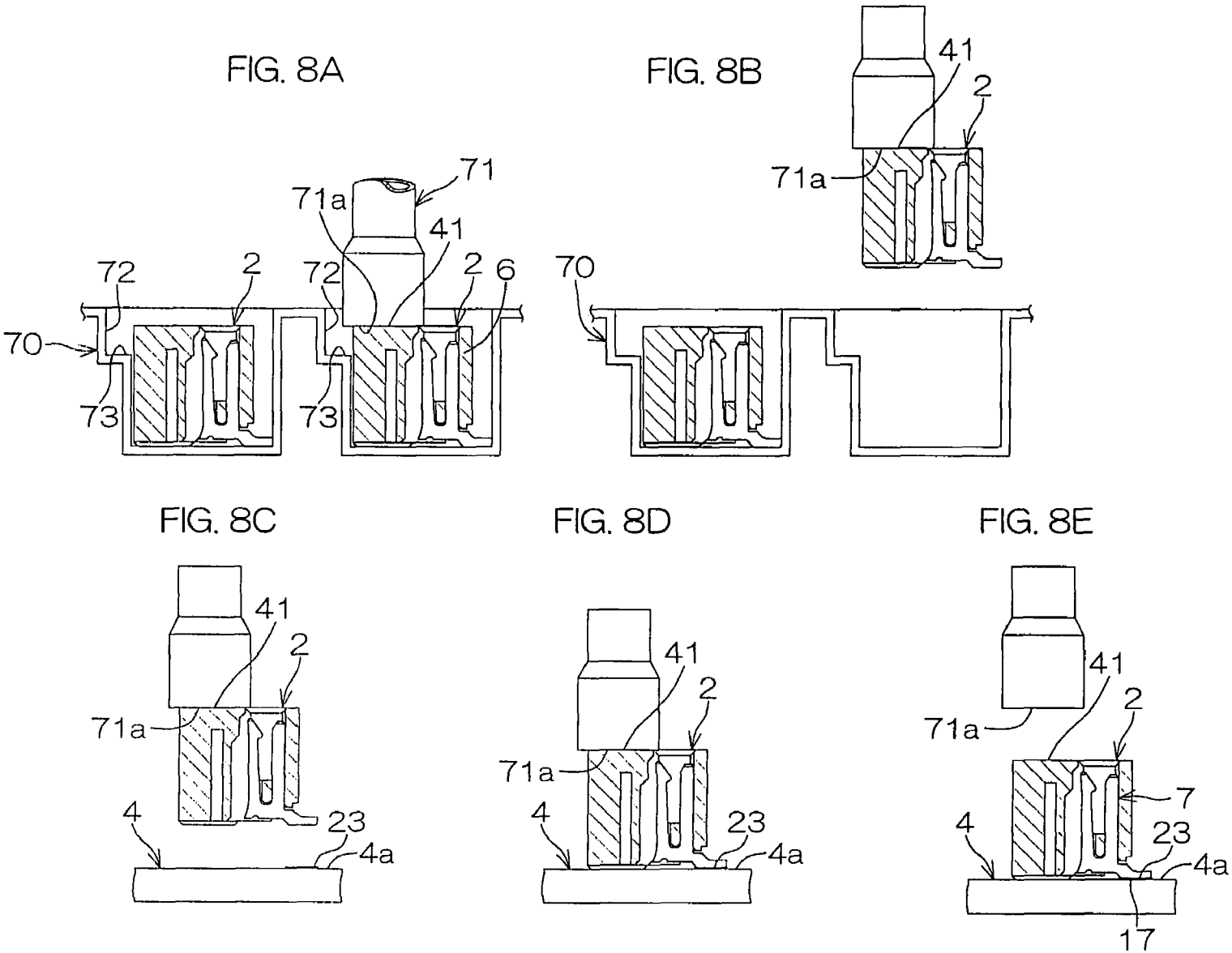
FIG. 8A shows a state that the base connector is accommodated in an embossed tape.
FIG. 8B shows a state that the base connector is pulled up by an adsorption member.
FIG. 8C shows a state that the base connector is carried above the circuit board.
FIG. 8D shows a state that the base connector is placed on the surface of the circuit board.
FIG. 8E shows a state that the adsorption member is spaced away from the base connector.

In a state that at least a part of the leading end of the adsorption nozzle 71*a* is in contact with the adsorbed face 41 of the base housing 6, a predetermined negative pressure is developed inside the adsorption nozzle 71*a*. In this state, as shown in FIG. 8B, the adsorption nozzle 71*a* is pulled up. Thereby, the base connector 2 is pulled up from the embossed tape 70. In addition, the adsorption nozzle 71*a* is attached to a driving mechanism including a motor and the like, and the driving mechanism is controlled by a control device including a CPU, RAM and ROM.

The base connector 2 pulled up from the embossed tape 70 is, as shown in FIG. 8C, conveyed to the position above the surface 4*a* of the circuit board 4 by moving the adsorption nozzle 71*a*. Then, as shown in FIG. 8D, the base connector 2 is placed on the surface 4*a* of the circuit board 4 by moving the adsorption nozzle 71*a* downward.

After the base connector 2 is placed on the surface 4*a* of the circuit board 4, in a state that the negative pressure inside the adsorption nozzle 71 is released, as shown in FIG. 8E, the adsorption nozzle 71*a* is pulled upward. Thereby, contact of the adsorption nozzle 71*a* with the adsorbed face 41 is released.

The tongue 17 of the base contact 7 placed on the circuit board 4 and the conductor pattern 23 are bonded together by reflowing cream solder coated in advance on the circuit board 4.

As described above, according to the present embodiment, the adsorbed face 41 of the base connector 2 is formed at a wide portion 51. Thereby, the adsorbed face 41 can be sufficiently secured in area. Further, since the adsorbed face 41 is flat, it can be firmly attached on the leading end of the adsorption nozzle 71*a*. As a result, it is possible to sufficiently increase an adsorption power on adsorption of the base housing 6 by the adsorption member 71.

Further, it is unnecessary that an adsorbed member such as tape is temporarily attached to the upper face of the base housing 6 for providing a face for adsorption in order to increase the adsorption power on adsorption of the base housing 6.

Thus, a work for attaching and removing the adsorbed member can be eliminated, and a necessity for using the adsorbed member itself can also be eliminated. As a result, it is possible to greatly reduce time and effort necessary for mounting the base connector 2 and also reduce waste.

Still further, the ridges 56, 57 respectively disposed on the pair of concave portions 45, 46 on the base housing 6 are to be engaged with the corresponding locking pawls 55, 54 of the socket connector 3. Thereby, each of the ridges 56, 57 is prevented from projecting forward of the central convex portion 44, thus making it possible to reduce the thickness of the base connector 2 in the front-and-rear direction X.

In addition, the ribs 49, 50 and the corresponding central convex portion 44 of the base housing 6 are connected by the pair of the ridges 56, 57. Thereby, the anterior wall 8 of the base housing 6 can be increased in strength. The ridges 56, 57 can be used as reinforcing members.

Further, by operating the adsorption member 71 adsorbing the base connector 2, an automatic mounting can be achieved in which the base connector 2 is placed on the surface 4*a* of the circuit board 4. Thereby, the base contact 7 can be electrically connected with the circuit board 4.

Further, when the rocking plate 58 is rocked by operating the rocking plate 58 of the socket connector 3, a part of the anterior wall 27 of the socket housing 25, which supports the supporting portion 59, can be elastically bent to be concaved. Thereby, a force acting on the supporting portion 59 can be distributed to the anterior wall 27, preventing the concentration of stress on the supporting portion 59. Therefore, fatigue of the supporting portion 59 can be suppressed. As a result, it is possible to suppress the engagement force of the locking pawls 54, 55 of the rocking plate 58 supported by the supporting portion 59 with the corresponding ridges 57, 56 from reducing.

Further, the pair of locking pawls 54, 55 are operated together. As a result, the pair of locking pawls 54, 55 can be respectively engaged with the corresponding ridges 57, 56 collectively. It is, therefore, possible to reduce the time and effort necessary for the locking and also prevent only one of the locking pawls 54, 55 from being locked.

Further, with a simple constitution in which the insertion hole 90 is formed on the anterior wall 27 of the socket housing 25, the hollow portion 61 can be provided.

Still further, the distance B between the locking pawls 54, 55 and the insertion convex portion 31 is made shorter in the front-and-rear direction X. For example, in the state that the locking pawls 54, 55 are in engagement with the corresponding ridges 57, 56, there is a case where an upward tensile force may act on the socket housing 25 due to the fact that the lead wire 5 is pulled. Even when the tensile force causes a moment to move the insertion convex portion 31 around the locking pawls 54, 55, the moment is short in arm length (distance B). Therefore, the moment can be made small. As a result, it is possible to more securely prevent the insertion convex portion 31 from being undesirably pulled off from the insertion concave portion 13.

In addition, for example, in terms of layout of a casing in which the circuit board 4 is accommodated, there is a case where a part of each lead wire 5 is disposed in a state that it is bent to one side of the left-and-right direction Y. In this case, when a tensile force acts on the lead wire 5, a moment in which a fulcrum is given on one side in the left-and-right direction Y and a point of action is given on the other side thereof is generated on the socket housing 25. However, the pair of locking pawls 54, 55 are disposed so as to be sufficiently spaced away in the left-and-right direction Y. Thereby, the pair of locking pawls 54, 55 are engaged with the corresponding ridges 57, 56, making it possible to resist the moment sufficiently. As a result, it is possible to more securely prevent the socket housing 25 from being undesirably pulled off from the base housing 6.

The present invention should not be limited to the above described embodiments but can be modified in various ways within a scope of the claims.

Figure 9:
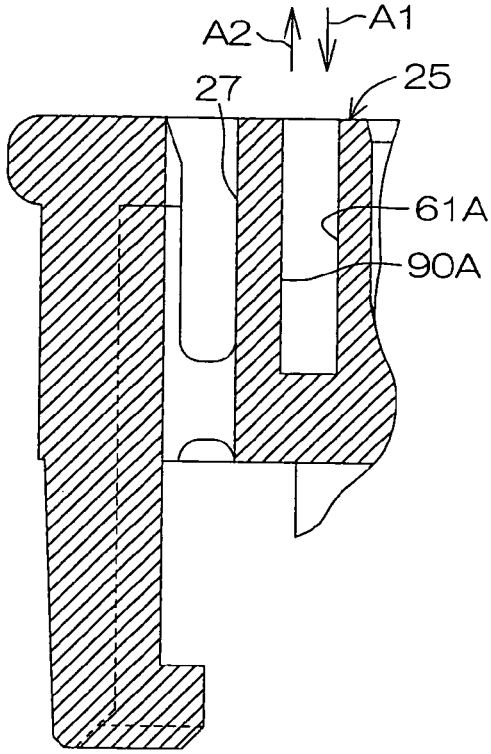
FIG. 9 is a sectional view showing a major part of another embodiment of the present invention.
Figure 10:
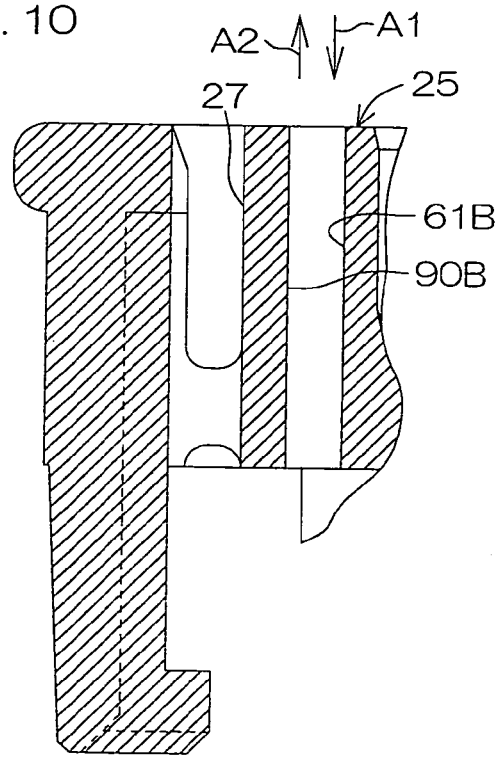
FIG. 10 is a sectional view showing a major part of still another embodiment of the present invention.

For example, the upper face 9*a* of the anterior wall 9 may not be flat excluding the upper face 44*b* of the central convex portion 44. Further, as shown in FIG. 9, an insertion hole 90A opened in the direction A2 opposing the connector connecting direction A1 may be formed in the anterior wall 27 of the socket housing 25 to constitute a hollow portion 61A. Still further, as shown FIG. 10, an insertion hole 90B opened both in the connector connecting direction A1 and the reverse direction A2 thereof may be formed in the anterior wall 27 of the socket housing 25 to constitute a hollow portion 61B.

The present invention is not limited to a surface mounting-type base connector but is also applicable to a DIP-type base connector.

A description has been given in detail for the present invention with reference to the specific embodiments. Various modifications and equivalents can be easily made by a person skilled in the art who understands the above content. Therefore, the present invention should be limited by a scope of claims and the equivalents thereof.

The present application corresponds to the Japanese Patent Application No. 2007-86862 filed on Mar. 29, 2007 with the Japan Patent Office, and all the disclosure made in the application shall be included in this citation.

What is claimed is:

1. A base connector, comprising an insulating base housing and a plurality of base contacts retained by the base housing wherein the base housing includes a bottom wall for being opposed to a circuit board, an anterior wall, a posterior wall and a pair of side walls disposed in a left-and-right direction, the anterior wall is provided with an anterior face which faces forward, and an upper face which faces upward, the anterior wall includes a central convex portion which is formed at a center portion in the left-and-right direction of the anterior face and projects forward, and a pair of concave portions formed on both sides sandwiching the central convex portion therebetween, at least a part of the upper face of the anterior wall including the upper face of the central convex portion is formed on a flat face, the upper face of the anterior wall is provided with a wide portion including the upper face of the central convex portion and relatively wide in a front-and-rear direction, and a pair of narrow portions corresponding in position to the pair of concave portions and relatively narrow in the front-and-rear direction, and a flat adsorbed face, which can be adsorbed by an adsorption member, is formed at the wide portion.

2. The base connector according to claim 1, wherein engagement portions are provided respectively at the pair of concave portions, and the engagement portion is engaged with a locking pawl of a counterpart connector in order to lock a connection state of the base connector with the counterpart connector to be connected with the base connector.

3. The base connector according to claim 2, wherein each of the engagement portions is accommodated in the corresponding concave portion.

4. The base connector according to claim 2, wherein the anterior wall is provided with a pair of ribs disposed at a pair of ends in the left-and-right direction of the anterior face, extending in a vertical direction and projecting forward, and each of the engagement portions includes a ridge connecting the central convex portion with a corresponding rib.

5. The base connector according to claim 4, wherein anterior faces of the pair of ribs and an anterior face of the central convex portion are respectively formed as flat faces which are flush.

6. The base connector according to claim 4, wherein a rear end of each of the concave portions constitutes a bottom of each of the concave portions, an upper face of each of the ridges has a predetermined inclination angle with respect to the bottom of the corresponding concave portion, and the predetermined inclination angle is in a range of more than 0° and not more than 90°.

7. The base connector according to claim 6, wherein the predetermined inclination angle is in a range of not less than 20° and not more than 90°.

8. The base connector according to claim 6, wherein the predetermined inclination angle is in a range of not less than 30° and not more than 70°.

9. The base connector according to claim 1, wherein the base contact is mounted on a surface of the circuit board.

10. The base connector according to claim 1, wherein a depth of each of the concave portions in the front-and-rear direction is half a thickness of the anterior wall.

11. The base connector according to claim 1, wherein the upper face of the anterior wall is formed in its entirety as a flat face which faces upward.

12. A socket connector connected with a base connector which includes an insulating base housing and a plurality of base contacts retained by the base housing, wherein the base housing includes a bottom wall for being opposed to a circuit board, an anterior wall, a posterior wall and a pair of side walls disposed in a left-and-right direction, the anterior wall is provided with an anterior face which faces forward, and an upper face which faces upward, the anterior wall includes a central convex portion which is formed at a center portion in the left-and-right direction of the anterior face and projects forward, and a pair of concave portions formed on both sides sandwiching the central convex portion therebetween, at least a part of the upper face of the anterior wall including the upper face of the central convex portion is formed on a flat face, the upper face of the anterior wall is provided with a wide portion including the upper face of the central convex portion and relatively wide in a front-and-rear direction, and a pair of narrow portions corresponding in position to the pair of concave portions and relatively narrow in the front-and-rear direction, and a flat adsorbed face, which can be adsorbed by an adsorption member, is formed at the wide portion, and engagement portions are respectively provided at the pair of concave portions, the socket connector connected with the base connector comprising:

an insulating socket housing capable of coupling with the base housing;

a socket contact retained by the socket housing and capable of coupling with the base contact;

a supporting portion projecting forward from the socket housing; and a rocking plate which can be operated in a rocking manner and supported by the supporting portion, wherein the socket housing includes an anterior wall for supporting the supporting portion, a locking pawl, which can be engaged with each of the engagement portions of the base housing, is provided on the rocking plate in order to lock a connecting state of the base connector with the socket connector, and the anterior wall of the socket housing constitutes a hollow portion opposed to a base end of the supporting portion in the front-and-rear direction.

13. The socket connector according to claim 12, wherein the rocking plate is integrally formed, and a pair of locking pawls are provided on the integral rocking plate, and each of the locking pawls is engaged with the corresponding engagement portion of the base housing.

14. The socket connector according to claim 12, wherein an insertion hole opened at least either in a connector connecting direction or in a reverse direction thereof is formed in the anterior wall of the socket housing, and the hollow portion is constituted by the insertion hole.

15. A complex type connector, comprising:

a base connector and a socket connector which are connected to each other, wherein the base connector includes an insulating base housing and a plurality of base contacts retained by the base housing, the base housing includes a bottom wall for being opposed to a circuit board, an anterior wall, a posterior wall and a pair of side walls disposed in a left-and-right direction, the anterior wall is provided with an anterior face which faces forward, and an upper face which faces upward, the anterior wall includes a central convex portion which is formed at a center portion in the left-and-right direction of the anterior face and projects forward, and a pair of concave portions formed on both sides sandwiching the central convex portion therebetween, at least a part of the upper face of the anterior wall including the upper face of the central convex portion is formed on a flat face, the upper face of the anterior wall is provided with a wide portion including the upper face of the central convex portion and relatively wide in a front-and-rear direction, and a pair of narrow portions corresponding in position to the pair of concave portions and relatively narrow in the front-and-rear direction, and a flat adsorbed face, which can be adsorbed by an adsorption member, is formed at the wide portion, and engagement portions are respectively provided at the pair of concave portions, the socket connector includes an insulating socket housing capable of coupling with the base housing; a socket contact retained by the socket housing and capable of coupling with the base contact; a supporting portion projecting forward from the socket housing; and a rocking plate which can be operated in a rocking manner and supported by the supporting portion, the socket housing includes an anterior wall for supporting the supporting portion, a locking pawl, which can be engaged with each of the engagement portions of the base housing, is provided on the rocking plate in order to lock a connecting state of the base connector with the socket connector, and the anterior wall of the socket housing constitutes a hollow portion opposed to a base end of the supporting portion in the front-and-rear direction.

* * * * *